US006398003B1

(12) United States Patent
Jasinetzky

(10) Patent No.: US 6,398,003 B1
(45) Date of Patent: Jun. 4, 2002

(54) ESCALATOR STEP

(75) Inventor: Arthur Jasinetzky, Munich (DE)

(73) Assignee: Georg Fischer Mossner GmbH, Munich (DE)

( * ) Notice: Subject to any disclaimer, the term of this patent is extended or adjusted under 35 U.S.C. 154(b) by 0 days.

(21) Appl. No.: 09/433,494

(22) Filed: Nov. 3, 1999

(30) Foreign Application Priority Data

Nov. 4, 1998 (DE) ..... 198 50 847

(51) Int. Cl.[7] ..... B66B 23/12
(52) U.S. Cl. ..... 198/333
(58) Field of Search ..... 198/333

(56) References Cited

U.S. PATENT DOCUMENTS 4,413,719 A * 11/1983 White ..... 198/333
4,858,745 A 8/1989 Haas et al.
5,337,879 A * 8/1994 Fischer ..... 198/333

FOREIGN PATENT DOCUMENTS

DE 3530 263 A1 4/1986
DE 196 51 585 A1 8/1998

* cited by examiner

*Primary Examiner*—Joseph E. Valenza
(74) *Attorney, Agent, or Firm*—Muramatsu & Associates

(57) ABSTRACT

The invention relates to an escalator step having an edge strip attached to a step body, which edge strip covers at least one edge of the escalator step in such a manner that it is flush at the top with a tread of the escalator step, the edge strip being mounted on the step body by means of a snap connection. The snap connection is formed by clips provided on the edge strip or on the step body, which clips engage in corresponding recesses in the step body or in the edge strip, respectively.

10 Claims, 9 Drawing Sheets

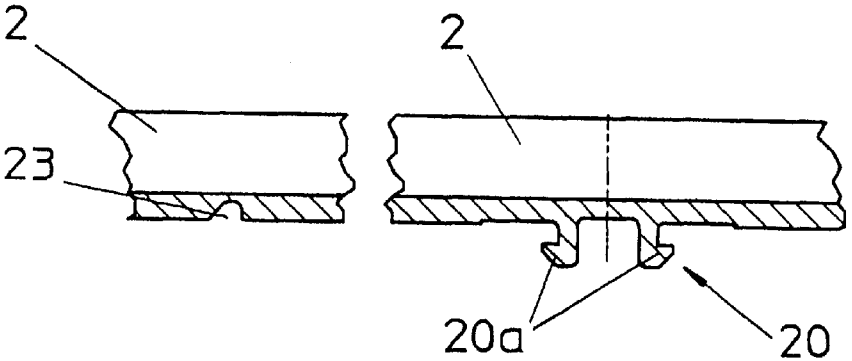
Fig.5a
Fig.3a
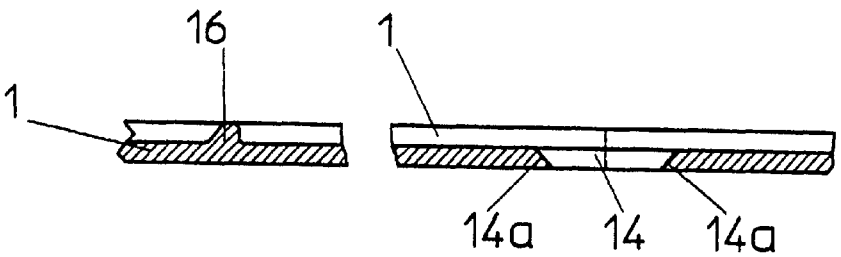
Fig.5b
Fig.3b
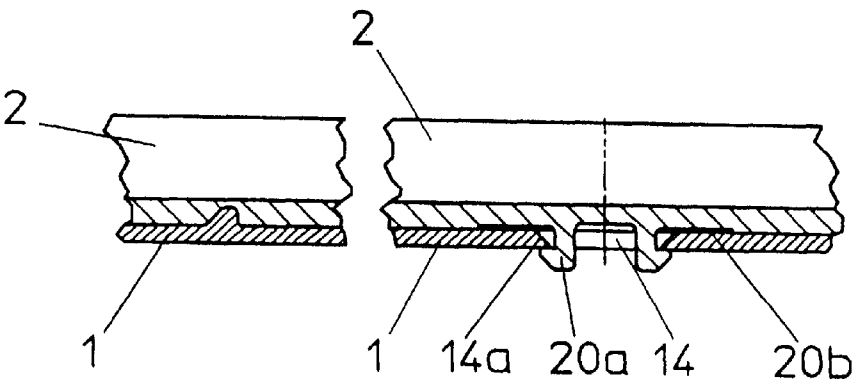
Fig.5c
Fig.3c

ESCALATOR STEP

FIELD OF THE INVENTION

The invention relates to an escalator step, and more particularly, to an escalator step for attaching an edge strip easily and securely thereto.

BACKGROUND OF THE INVENTION

From DE-A-35 30 263, there is known an escalator step in which an edge strip is attached to the front edge of the escalator step, which has appropriate recesses. To that end, the body of the escalator step has recess grooves into which corresponding projections on the edge strip are to be inserted. According to the preferred embodiments, the edge strip is held on the step body by way of a screwed fastening.

Although that escalator step allows impact protection to be provided at the comparatively sensitive front edge of the escalator step, it has the disadvantage that the susceptibility to breakdown increases in continuous operation. Obviously, the edge strip loosens as a result of the changing dynamic load as the passengers put weight on the step, or possibly as a result of contact with a comb plate of the escalator.

In many countries, edge strips of different colours are already prescribed. When using edge strips that are attached to the body of an escalator step, it is important that the edge strip be joined to the escalator step permanently and without play. Otherwise there is the risk that, in the course of time, dirt will find its way into resulting gaps and, although such dirt leads to a reduction in the play between the edge strip and the step body, it produces a tilting error which may result in a collision with the comb plate.

From DE-OS 196 51 585, there is known an escalator step in which there are attached to a step body edge strips of plastics material which cover at least one edge of the escalator step, especially the front. edge and/or both lateral edges, in such a manner that they are flush at the top with a tread of the escalator step. For fastening the edge strip to the step body, at least one undercut is provided on the step body, the edge strip being fastened to the step body via the undercut, in one piece, in an interlocking manner, by means of injection moulding.

That solution uses no screwed connections at all, so that there is no risk of the screwed connections being loosened as a result of mechanical vibrations and/or changing loads. In addition, the reliability of the mounting is improved considerably as compared with an edge strip fastened to the ends of pins simply by thermal anchoring. Separate mounting measures by means of screwed connections, which are comparatively labour-intensive, are also no longer required. However, a certain amount of additional expenditure is required during manufacture, since the entire escalator step must be mounted and the moulded bodies must be correspondingly large.

Further, there is known from U.S. Pat. No. 4,858,745 an escalator step in which there are provided on the escalator step lateral edge strips which in the unloaded condition leave an air gap between the escalator step and the fixed lateral boundary of the escalator, which air gap is able to close as a result of a load being placed on the peripheral opening. The edge strips can be inserted into appropriate recesses in the step body. The disadvantage of that design is, however, that the escalator step, which is manufactured as a die-cast part, must still be machined mechanically in order to provide adequate hold for the edge strips. That type of manufacture is, however, relatively expensive.

In order to fix the edge strips in their longitudinal direction, they are screwed to the step body in some embodiments.

SUMMARY OF THE INVENTION

The problem underlying the invention is, therefore, to produce an escalator step in which the edge strip can be both produced and secured without particular expense and the edge strips are nevertheless reliably mounted on the escalator step.

According to the invention, the snap connection is formed by means of clips provided on the edge strip or on the step body, which clips engage in corresponding recesses in the step body or in the edge strip, respectively. An especially simple method of mounting is thereby obtained and, in addition, the edge strips can be manufactured separately as an injection-moulded part, without the step body.

In order to secure the edge strip in position in the horizontal direction, it is preferred to provide projections on the edge strip or on the step body, which projections engage in corresponding recesses in the step body or in the edge strip, respectively. The projections are in the form, for example, of teeth, which extend parallel to the front edge of the escalator step.

Other advantages and embodiments of the invention are described in greater detail with reference to the following description of an exemplary embodiment, and the drawing.

BRIEF DESCRIPTION OF THE DRAWINGS

FIG. 3 shows a sectional view of the escalator step along the line Ill—Ill of FIG. 2.

FIG. 5 shows a sectional view of the escalator step along the line V—V of FIG. 2.

DETAILED DESCRIPTION OF THE INVENTION

Figure 1:
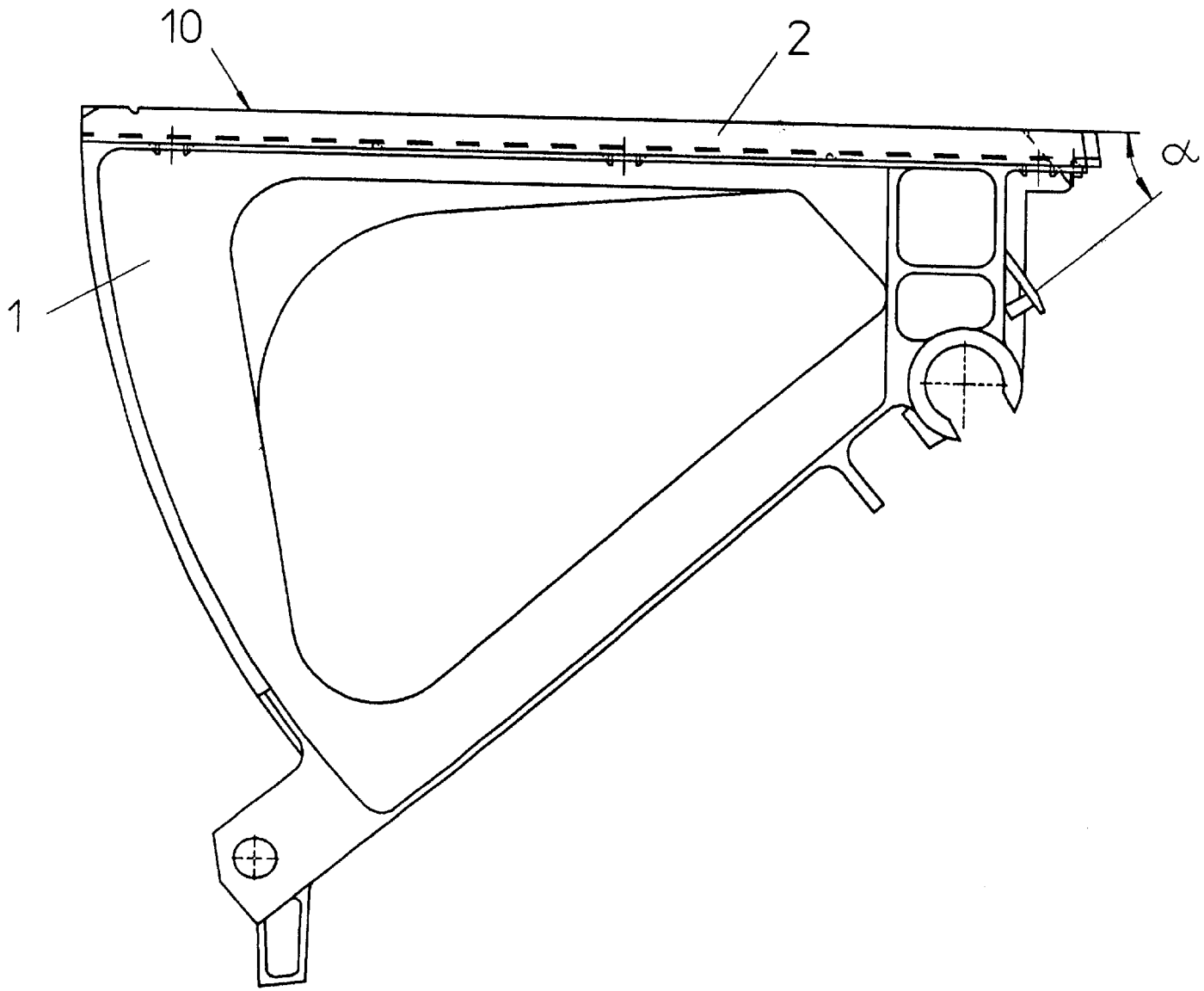
FIG. 1 shows a side view of the escalator step of the present invention.
Figure 2:
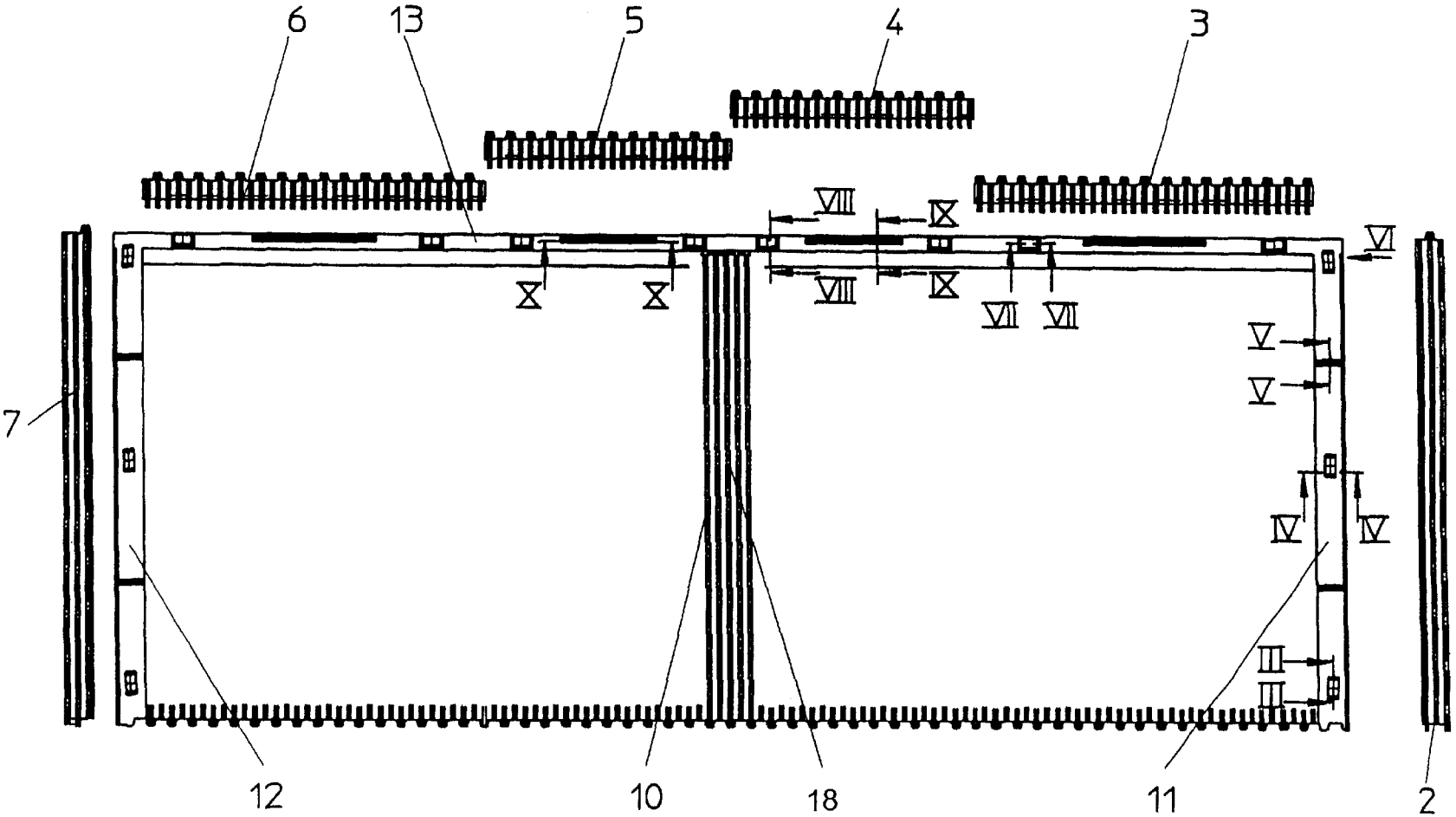
FIG. 2 shows a plan view of the escalator step of the present invention with edge strips shown separately.

The escalator step shown in FIGS. 1 and 2 has a step body 1, which is usually manufactured as an aluminium die-cast part, and an edge strip 2 fastened thereto. In the exemplary embodiment shown, edge strips 2, 3, 4, 5, 6 and 7 are provided both in the region of the two lateral edges 11, 12 and in the region of the front edge 13. The edge strips terminate at the top flush with a tread 10 of the escalator step.

The individual edge strips 2–7 are mounted on the step body 1 by means of a snap connection. The form of the edge strips and of the snap connection are explained in greater detail below with reference to FIGS. 3 to 10. In each of those Figures, Figure a shows an edge strip, Figure b shows a partial region of the step body and Figure c shows a view of the edge strip mounted on the step body.

The snap connection is formed by clips provided on the edge strip or on the step body, which clips engage in corresponding recesses in the step body or in the edge strip, respectively. Advantageously, the clips 20 are provided on the edge strip 2 and the recesses 14 are provided in the step body 1, as is shown in FIGS. 3*a*–3*c*. The clips 20 have two opposing locking projections 20*a*, which are pressed together slightly as the clip 20 is introduced into the recess 14 in order then to engage with undercuts 14*a* in the step body 1.

When the edge strip 2 is in the mounted condition according to FIG. 3*c*, there is in the region around the recess 14 a horizontal gap 20*b* which is formed by a corresponding recess in the edge strip. The gap is, for example, from 0.2 to 0.3 mm and allows the locking projections 20*a* to be inserted securely and the edge strip to be fastened without play.

The recess 14 is constructed to widen upwards at least at its opposing sides that come into contact with the locking projections 20*a*. The locking projections 20*a* are correspondingly bevelled in the area of the regions that come into contact with the boundary sides of the recess 14, in order to facilitate introduction of the clips 20 into the recess 14.

Figure 4A:
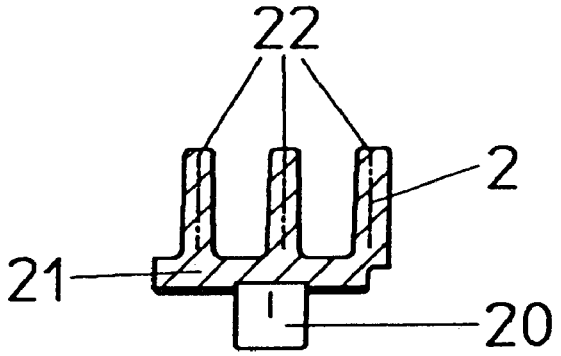
FIG. 4 shows a sectional view of the escalator step along the line IV—IV of FIG. 2.
Figure 4B:
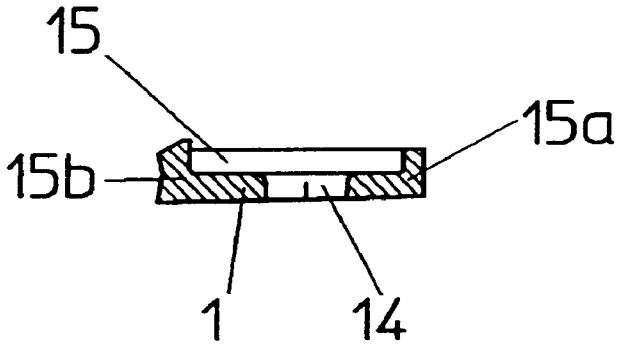
Figure 4C:
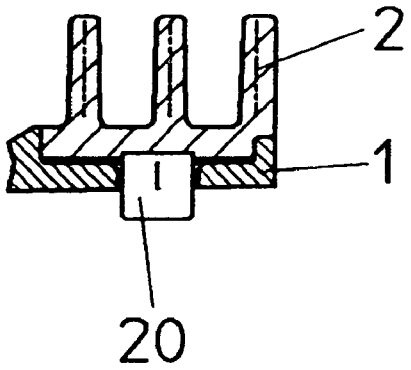

FIGS. 4*a* to 4*c* show a section transverse to the longitudinal extent of the edge strip 2 or of the lateral edge of the escalator step. The edge strip has a base 21, from which ribs 22 project perpendicularly upwards. The spacing of the ribs 22 corresponds to the spacing of the ribs 18 of the step body 1. The edge strip 2 is inserted by its base 21 into a suitably complementarily formed recess 15 in the lateral edge of the step body 1. The lateral boundaries 15*a*, 15*b* of that recess 15 hold the edge strip 2 transversely to its longitudinal extent in the required manner. The base 21 of the edge strip 2 has a suitable complementary recess in the region of the outer boundary or of the outer tooth 15*a* of the recess 15, so that the edge strip 2 and the step body 1 with its outer boundary 15*a* merge flush together.

In order to fix the edge strip 2 in its longitudinal direction, there is provided on the step body 1 at least one transverse tooth 16 which engages in a suitably complementarily formed recess 23 in the edge strip 2 as shown in FIGS. 5*a* to 5*c*.

The edge strip 2 in the region of the lateral edge of the escalator 1 is provided with three clips 20. In order to fix the edge strip 2 in the direction of its longitudinal extent, there are additionally provided two teeth 16 (see FIG. 1). The teeth 16 and the lateral boundary 15*a* of the recess 15 in the step body 1 serve essentially to fix the edge strip 2 in a plane parallel to the tread 10. The clips 20 secure the edge strip substantially in the vertical direction, although horizontal fixing is also effected by the clips 20.

Figure 6A:
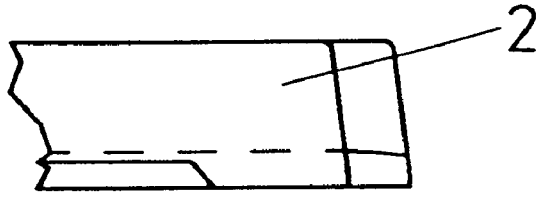
FIG. 6 shows a sectional view of the escalator step along the line VI—VI of FIG. 2.
Figure 6B:
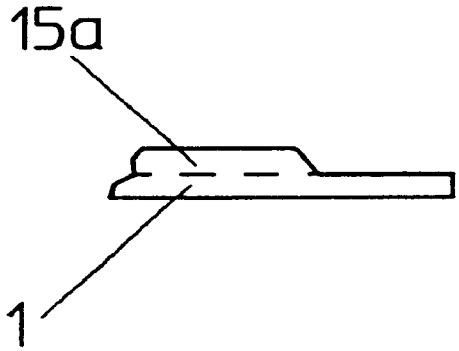
Figure 6C:
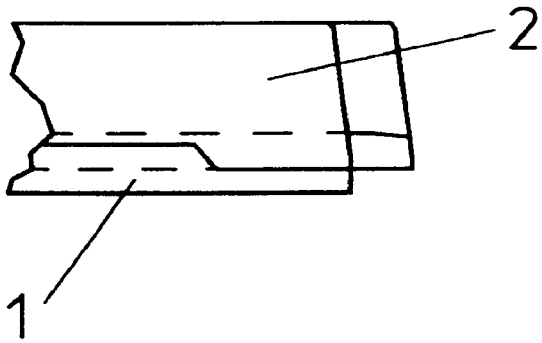
Figure 7A:
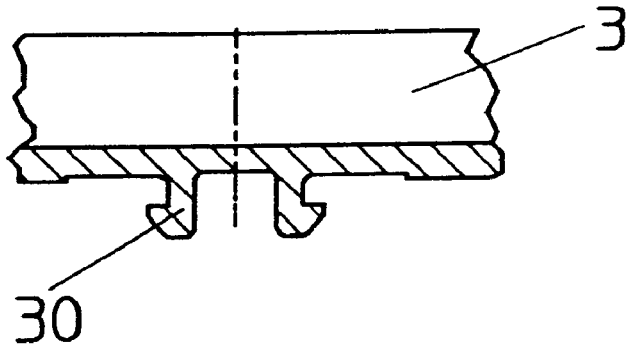
FIG. 7 shows a sectional view of the escalator step along the line VII—VII of FIG. 2.
Figure 7B:
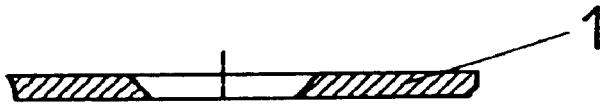
Figure 7C:
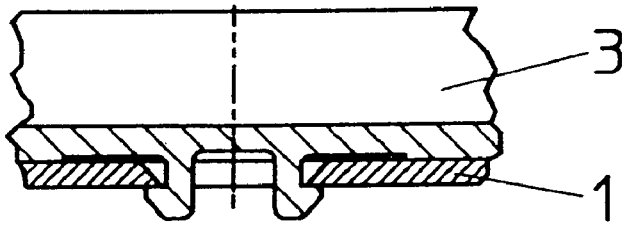

FIG. 6 show the rear end of the edge strip 2 or of the lateral edge of the step body 1. It will be seen from those Figures especially that the boundary 15*a* does not extend right to the end.

The edge strip at the front edge 13 of the step body 1 is divided into a plurality of immediately adjoining edge strips 3, 4, 5 and 6. By producing, for example, edge strips 3 and 6 and edge strips 4 and 5 of different lengths, five different widths of escalator step can be produced using two injection moulds.

The edge strips 3, 4, 5 and 6 are identical to one another except for their lengths. The nature of the snap connection with the step body 1 also corresponds to the snap connection for the edge strip 2, as will be seen especially from FIGS. 7 and 8.

Figure 9A:
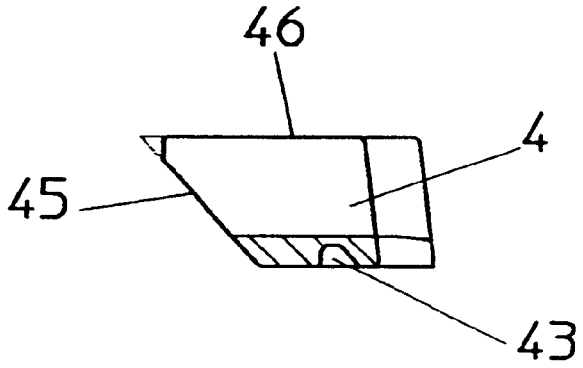
FIG. 9 shows a sectional view of the escalator step along the line IX—IX of FIG. 2.
Figure 9B:
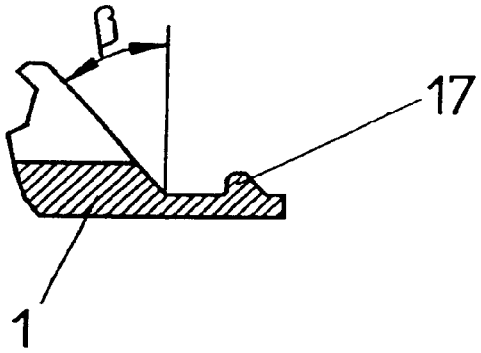
Figure 9C:
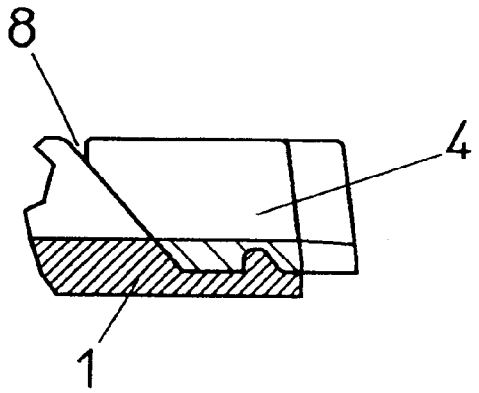

In FIGS. 9*a* to 9*c*, in order to fix the edge strips to the front edge of the step body 1, teeth 17 are in turn provided, which teeth cooperate with suitably complementarily formed recesses 43, the tooth 17 being provided on the step body 1 and the recess 43 being provided in the edge strip. However, the teeth 17 and the recesses 43 extend only over a portion of the length of the associated edge strip.

In order to improve removal from the mould during manufacture of the step body 1, the edge strips at the front edge of the step body 1, in the region of their end face 45 facing the step body 1, are bevelled with respect to the plane of the tread 10, so that the edge: strip overlaps the step body in the region of its end face 45. The angle $\beta$ of that bevel at the step body 1 (see FIG. 9*b*) is to be slightly larger than the angle $\alpha$ of the lower inclination of the escalator step (see FIGS. 1 and 9*b*). In the case of an escalator gradient of 35° ($=\alpha$), a mould-removal angle of, for example, from 36 to 40° ($=\beta$) can be selected. The angle difference ($\beta-\alpha$) should be from 1 to 10° where possible.

Figure 10A:
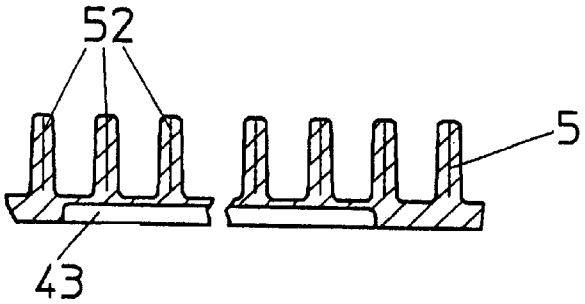
FIG. 10 shows a sectional view of the escalator step along the line X—X of FIG. 2.
Figure 10B:
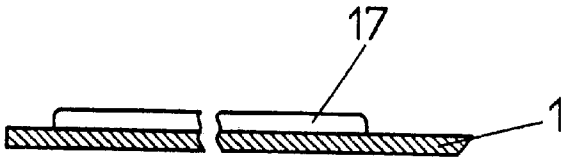
Figure 10C:
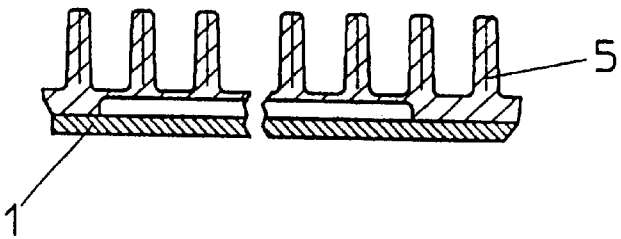

FIG. 10 shows a sectional view in the longitudinal direction of the edge strip 5, in which especially the recess 43 and the tooth 17 can also be seen. The ribs 52 of the edge strip 5, and the ribs. of the other edge strips in the region of the front edge, extend transverse to the longitudinal extent of the edge strips, as will be seen especially also in FIG. 10. Advantageously, the ribs 52 are in alignment with the corresponding ribs 18 of the step body 1.

As will be seen from FIG. 9*a*, the sloping end face 45 does not merge into the horizontal tread 46 of the edge strip 4 at a point. The transition region, which is shown by broken lines, is, rather, truncated, so that when the edge strip 4 is in the mounted condition, a groove 8 forms between the step body 1 and the edge strip 4 (see FIG. 9*c*). In that manner it is possible on the one hand to compensate for manufacturing tolerances and, in addition, the groove 8 is a boundary of the escalator step that can be felt, for example, with a stick.

Figure 8A:
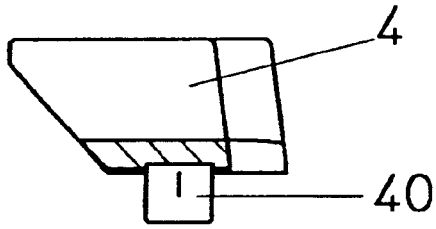
FIG. 8 shows a sectional view of the escalator step along the line VIII—VIII of FIG. 2.
Figure 8B:
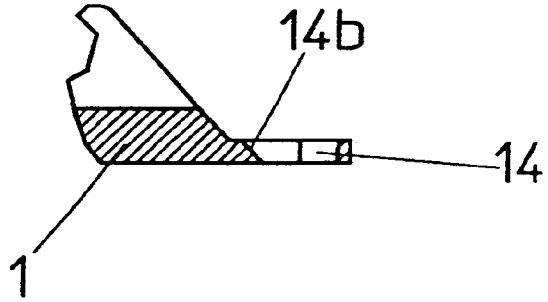
Figure 8C:
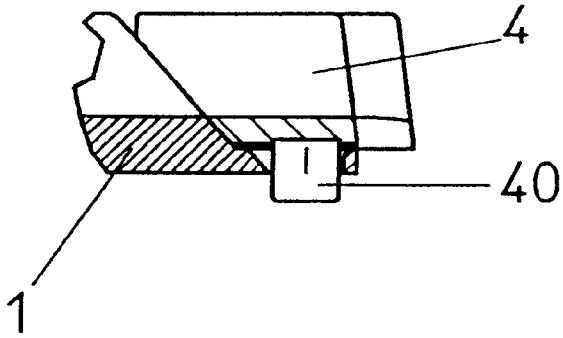

In FIGS. 8*a* to 8*c*, the recesses 14 in the region of the step body 1 are preferably rectangular in shape, it being possible for the boundary surfaces of that recess to be bevelled in order to facilitate introduction of the clips. In the region of the front edge it is, moreover, necessary for the rearmost of the boundaries 14*b* of the recess 14 that extend parallel to the front edge also to be bevelled, in order to ensure that the step body 1 can be removed from the mould.

In the embodiment shown, the locking projections of the clips each extend in the longitudinal direction of their edge strips. Within the scope of the invention, the clips may, of course, also be arranged rotated through 90°. In addition to the rectangular form of the recesses, a round recess with suitably formed clips would also be conceivable.

Because the edge strips with the clips are injection moulded in one piece, separate from the step body, their manufacture is relatively simple. The provision of the corresponding recesses in the step body requires no additional expense either. When the edge strips are mounted on the step body, they must simply be snapped on. As compared with a screwed connection or thermal anchoring, that type of fastening is possible without any great expense.

What is claimed is:

1. An escalator step, comprising:

a step body; and an edge strip attached to the step body wherein the edge strip covers at least one edge of the escalator step in such a manner that it is flush at the top with a tread of the escalator step, the edge strip being mounted on the step body by means of a snap connection;

wherein the snap connection is formed by clips provided on the edge strip or on the step body, which clips engage in corresponding recesses in the step body or in the edge strip, respectively, and wherein the snap connection includes a horizontal gap formed between the edge strip and the step body at close proximity with each of the recesses.

2. An escalator step according to claim 1, wherein, for additionally securing the edge strips in place, projections are provided on the edge strip or on the step body, which projections engage in corresponding recesses in the step body or in the edge strip, respectively.

3. An escalator step according to claim 2, wherein the projections are formed by teeth which extend parallel to the front edge of the escalator step.

4. An escalator step according to claim 1, wherein the clips are manufactured from plastics material in one piece with the edge strips.

5. An escalator step according to claim 1 wherein a plurality of immediately adjoining edge strips are provided over the length of a rear edge of the escalator step.

6. An escalator step according to claim 1, wherein the recess in the step body is rectangular in shape.

7. An escalator step according to claim 1 wherein the end face of the edge strip that comes into contact with the step body is bevelled in the rear edge region of the escalator step with respect to the plane of the tread in such a manner that the edge strip overlaps the step body in the region of that end face.

8. An escalator step according to claim 7, wherein the transition region between that end face and the tread of the edge strip is flattened, so that when the edge strip is in the mounted condition, a groove extending transverse to the escalator step is formed.

9. An escalator step according to claim 1, wherein when the edge strip is in the mounted condition, there remains in the region around the recess, between the escalator step and the edge strip, the horizontal gap of about 0.2 to 0.3 mm, thereby securely attaching the edge strip to the step body without play.

10. An escalator step according to. claim 1 wherein each edge strip. is fixed relative to the escalator step by means of at least two clips and at least one tooth.

* * * * *